US008891337B2

(12) United States Patent
Le Doussal et al.

(10) Patent No.: US 8,891,337 B2
(45) Date of Patent: Nov. 18, 2014

(54) TIME PIECE PROVIDED WITH A DAY/NIGHT DISPLAY AND DAY/NIGHT DISPLAY

(71) Applicant: Montblanc-Simplo GmbH, Hambourg (DE)

(72) Inventors: Gildas Le Doussal, Villeret (CH); Pascal Winkler, Saint-Blasie (CH)

(73) Assignee: Montblanc-Simplo GmbH, Hamburg (DE)

( * ) Notice: Subject to any disclaimer, the term of this patent is extended or adjusted under 35 U.S.C. 154(b) by 0 days.

(21) Appl. No.: 14/037,689

(22) Filed: Sep. 26, 2013

(65) Prior Publication Data

US 2014/0086019 A1 Mar. 27, 2014

(30) Foreign Application Priority Data

Sep. 27, 2012 (EP) ..... 12006745

(51) Int. Cl.
*G04B 49/00* (2006.01)
*G04B 19/26* (2006.01)
*G04B 19/20* (2006.01)

(52) U.S. Cl.
CPC ..... *G04B 19/262* (2013.01); *G04B 19/202* (2013.01)
USPC ..... 368/17; 368/232

(58) Field of Classification Search
USPC ..... 368/15–18, 223, 231–234
See application file for complete search history.

(56) References Cited

U.S. PATENT DOCUMENTS

| | | | | |
|---|---|---|---|---|
| 2,583,797 | A * | 1/1952 | Rosfelder | 368/234 |
| 4,551,027 | A * | 11/1985 | Spruck | 368/15 |
| 4,759,002 | A * | 7/1988 | Cash | 368/15 |
| 4,932,569 | A * | 6/1990 | Ruscitti et al. | 222/402.24 |
| 6,754,139 | B2 * | 6/2004 | Herbstman et al. | 368/77 |

FOREIGN PATENT DOCUMENTS

| | | |
|---|---|---|
| CH | 153246 | 3/1932 |
| CH | 453216 | 9/1967 |

OTHER PUBLICATIONS

European Search Report dated Feb. 21, 2013; Application No. 12006745.9.

* cited by examiner

*Primary Examiner* — Sean Kayes
(74) *Attorney, Agent, or Firm* — Young & Thompson

(57) ABSTRACT

A digital day/night display device includes an hour disc provided with ciphers 1-12 representing the hours, and made such that light can pass either through the ciphers or through parts of the hours disc surrounding these ciphers; a rotative day/night disc located under the hours disc including a first zone and a second zone of different colors or shadings; and a mechanism for driving in rotation the hours disc and the day/night disc. The zones extend under the ciphers of the hours disc. Also provided are elements for driving the hours disc in a continuous way and at a constant speed at the rate of two revolutions in twenty-four hours and other elements for driving in a continuous way but intermittently the day/night disc at a rate of one revolution in twenty-four hours. A time piece provided with this digital day/night display device is also described.

12 Claims, 5 Drawing Sheets

TIME PIECE PROVIDED WITH A DAY/NIGHT DISPLAY AND DAY/NIGHT DISPLAY

FIELD OF THE INVENTION

The present invention relates to a digital day/night hour display comprising an aperture in a dial showing at least one cipher corresponding to an hour indication; an hour disc comprising, uniformely distributed along its periphery hour ciphers 1-12, and made so that the light may pass either through the ciphers or through a portion of the hour disc around the ciphers; a day/night disc located under the hours disc comprising two zones of different colors or shadings; and a driving in rotation mechanism of the hours disc and of the day/night disc. The invention relates also to a time piece provided with such a hour display device.

The present invention aims the realization of such a day/night hour display permitting a good lecture of the hour through big ciphers and a dynamic indication of the elapsing time through a constant dragging movement of the hours disc as well as a differentiation of the day hours from the night hours.

The invention has also for aim to realize a digital hour display permitting to vary the coloration of the ciphers located in the aperture of the dial or of the background of the aperture indicating the hour during the day/night transition to indicate in a more marked manner the elapsing of time with the movement of this day/night or night/day transition. One looks thus to represent dynamically the coming of the daybreak and of the twilight or inversely.

BACKGROUND OF THE INVENTION

One knows from CH-153246 a time piece with jumping hours comprising an hour disc in which the hour ciphers may be cut out under the aperture of the dial showing the hour cipher, this disc comprising two zones of different colors. This day/night disc is indexed of half a turn at six o'clock in the evening and at six o'clock in the morning to modify the appearance of cipher located in the aperture of the dial indicating if it is an hour of the night or of the day.

SUMMARY OF THE INVENTION

Such a display where the two discs, hour and day/night, are actuated step by step nearly instantaneously does not permit to represent the time elapsing nor the transition day/night in a progressive and continuous way.

The present invention has for its object a digital hour day/night display device obviating to the drawbacks of the prior art cited here above and permitting to reach the proposed aim; hour digital day/night display device comprising an aperture in a dial through which at least one cipher can be seen corresponding to an hour indication; an hour disc comprising uniformely distributed along its periphery hour ciphers 1-12 made in such a manner that the light can pass either through the ciphers or through a portion of the hours disc around these ciphers; a day/night disc located under the hour disc comprising two zones of different colors or shadings; and a driving in rotation mechanism of the hours disc and the day/night disc, this display device being characterized in that the two zones of the day/night disc extend under the hours disc comprising the ciphers 1-12; and by the fact that the driving in rotation mechanism of the hours disc and of the day/night disc comprises means driving the hours disc continuously at a rate of two turns in 24 hours and means driving continuously, but intermittently, the day/night disc at a rate of one turn in 24 hours.

BRIEF DESCRIPTION OF THE DRAWINGS

The invention has also for its object a timepiece comprising a digital day/night hour display such as described here above.

The attached drawings show schematically and by way of example a time piece provided with a digital day/night hour display and an embodiment of the said display device.

FIGS. 1 and 2 show a wrist watch provided with the hour day/night display device according to the invention.

DETAILED DESCRIPTION OF THE INVENTION

Figure 1:
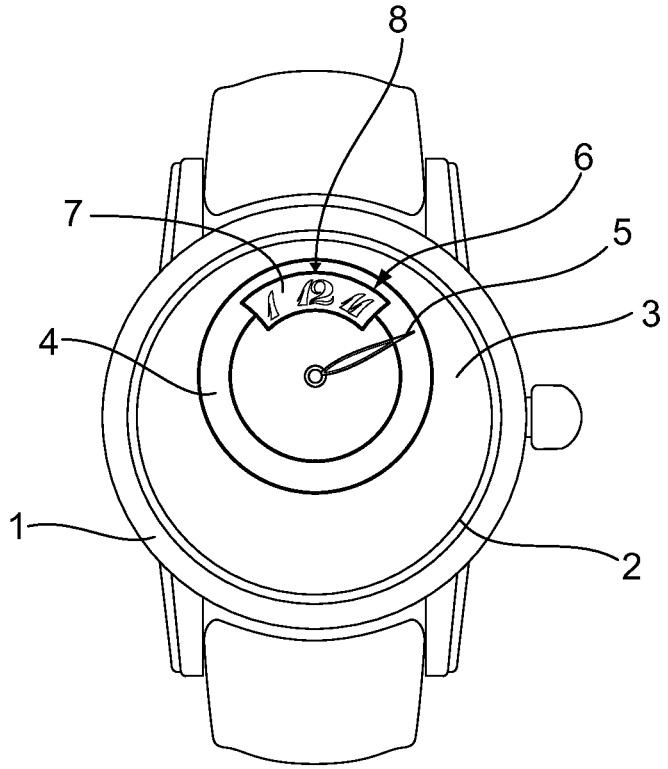
FIG. 1 shows a wrist watch provided with a display device indicating ten minutes past noon.

The wrist watch comprises a casing 1 provided with a glass 2 through which a dial 3 is visible which is provided with a minutes graduation 4 cooperating with a minutes hand 5 and an aperture 6 through which a portion of a hour disc 7 is visible. This hour disc comprises uniformely distributed along its periphery ciphers 1 to 12 indicating the hours of the day and of the night, this hour disc making two turns in twenty-four hours. The ciphers representing the hours cooperate with a fix index 8 of the dial to indicate the hour. These ciphers 1 to 12 are, in this embodiment, either cut out in the hour disc or written on a transparent annular zone of the hour disc so that the ciphers 1 to 12 appear on a colored back or in color themselves of the coloration of a zone of a day/night disc 9 located under the hour disc.

The day/night disc 9 is coaxial to the hour disc 7 and comprises on an annular zone visible through the aperture 6 of the dial 3 two zones of different colors generally white and grey or black.

Through the aperture 6 of the dial 3 several ciphers of the hour disc, for example three ciphers can be seen in the shown embodiment.

The hour disc 7 is driven in a continuous way through the watch movement at the rate of two turns in twenty-four hours.

The day/night disc 9 is driven in rotation intermittently at a rate of one turn in twenty-four hours.

Therefore the hours of the day, during which the clear zone of the day/night disc is visible through the aperture 6, appear clear on a clear background, whereas the hours of the night, during which the dark zone of the day/night disc is visible through the aperture 6, appear in dark on a dark ground. In variants, the day/night colors can be reversed, and more generally, any colors or shades can be used to differentiate between the day and the night.

Figure 2:
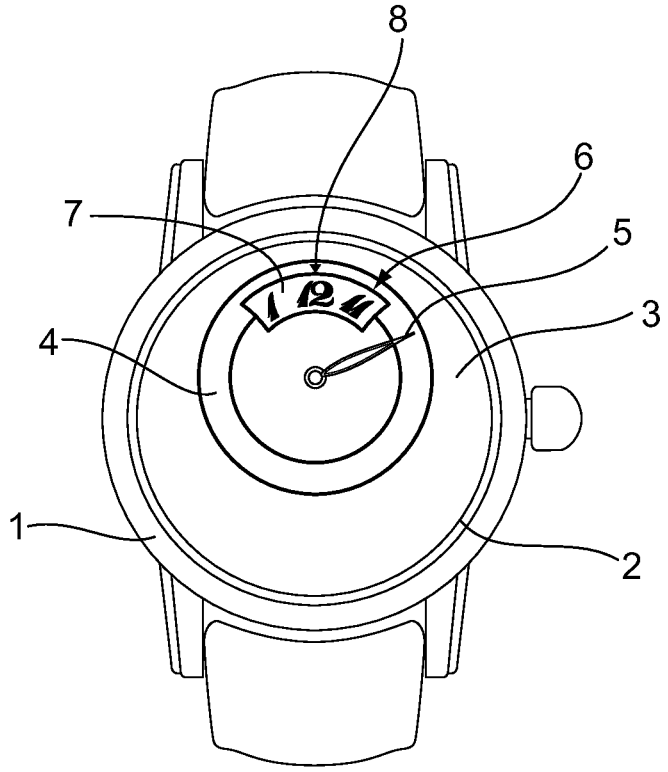
FIG. 2 shows the watch of FIG. 1 displaying ten minutes past midnight.
Figure 3:
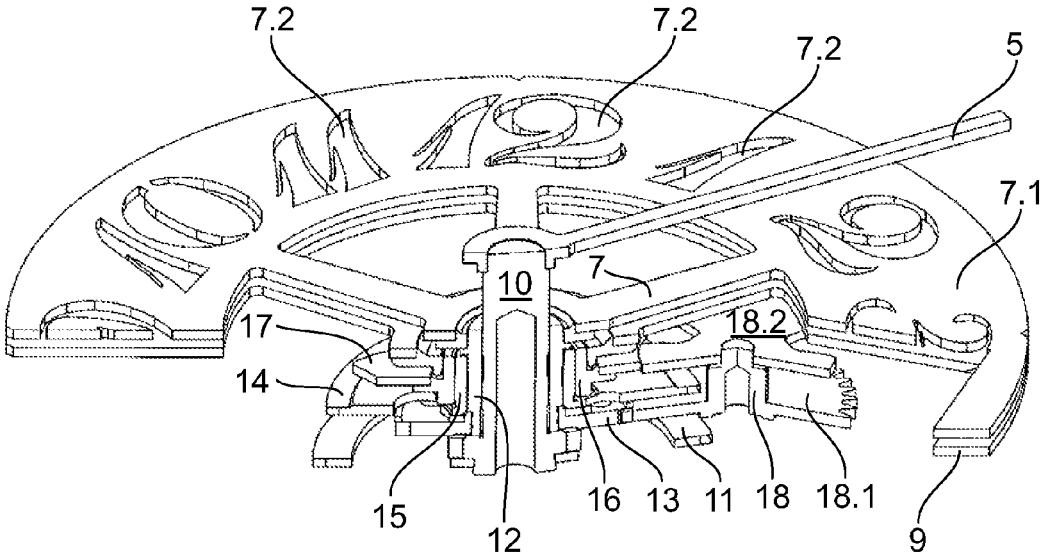
FIG. 3 shows partially in perspective the mechanism of the display device.
Figure 4:
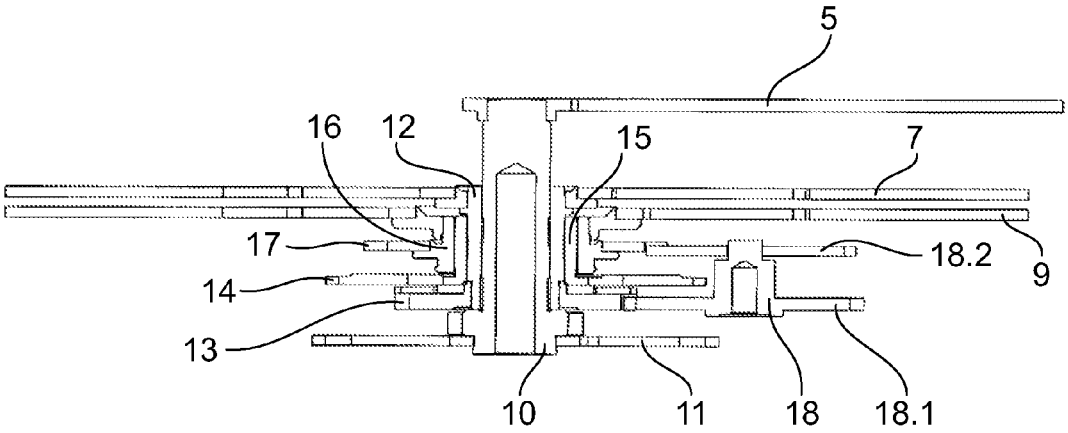
FIG. 4 is a cross section showing the display device.
Figure 5:
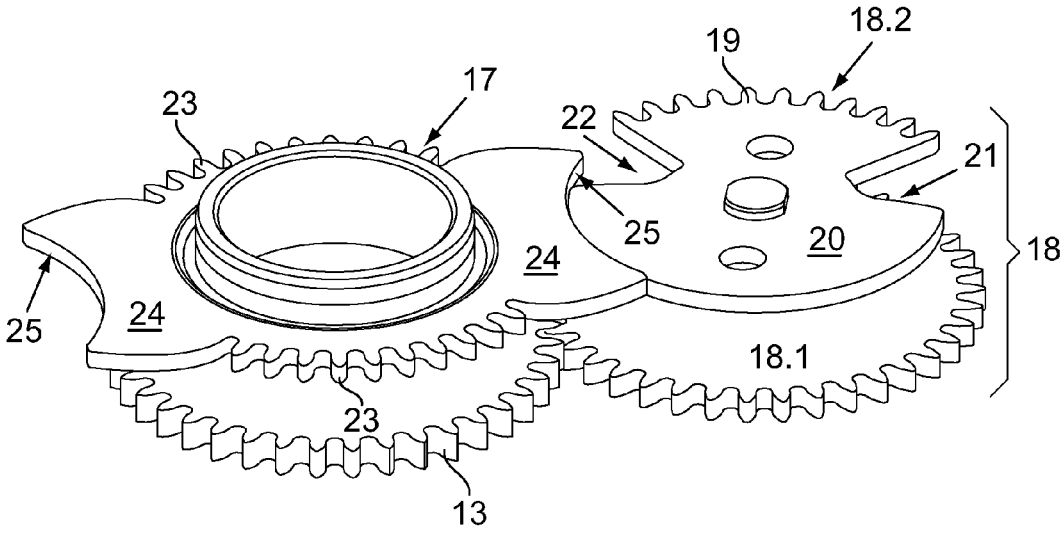
FIG. 5 is a detail of the driving mechanism of the display device.

As an example FIG. 1 shows the watch indicating ten minutes past noon, the cipher twelve appears in clear, whereas FIG. 2 shows the watch displaying ten minutes past midnight, the cipher twelve appears in dark.

In this embodiment the ciphers 1-12 are cut out in the hour disc, this hour disc revolves clockwise and the ciphers 1-12 increase in the anticlockwise direction.

As will be seen later, this driving mechanism of the hours disc and of the day/night disc is particular in that the hours disc is driven continuously, at a constant speed, by the watch movement at the rate of two turns in twenty four hours, whereas the day/night disc is driven in an intermittent way. In fact this day/night disc is either driven in a dragging or continuous way with the hours disc, or it stays still. Preferably in a cycle of twenty-four hours the day/night disc revolves during twelve hours and is maintained still during the other twelve hours. More particularly in the present embodiment, the day/night disc is driven at an average speed of one revolution in twelve hours from three o'clock to nine o'clock and from fifteen o'clock to twenty o'clock. One obtains thus a dynamic display of twilight and daybreak, the changing of colors in the aperture being progressive from five o'clock to nine o'clock and from seventeen o'clock to twenty o'clock.

In this first embodiment the aperture 6 of the dial shows three successive hours ciphers of the hours disc 7. These ciphers are cut out in the hours disc 7 and therefore the underlying day/night disc 9 is visible through these cutouts.

In this embodiment (FIG. 1 and FIG. 2) the hours disc 7 and the day/night disc 9 revolve clockwise. The cut out ciphers in the hours disc 7 are decreasing in the clockwise direction.

FIGS. 3 to 6 of the attached drawing show an embodiment of the driving mechanism of the hours disc 7 and the day/night disc 9 for a hour day/night display in which the hours disc 7 and the day/night disc 9 revolve anticlockwise; The ciphers carried by the hours disc 7 are increasing in the clockwise direction.

The hour disc 7 comprises a peripheral rim 7.1 the width of which is greater than the one of the aperture 6 of the dial and located under this aperture 6. This peripheral rim 7.1 of the hours disc 7 is pierced with holes 7.2 representing the ciphers 1-12 uniformely distributed on 360°. These holes 7.2 represent the ciphers from 1 to 12 increasing in the clockwise direction have a size such that three successive ciphers can be seen simultaneously in the aperture 6 of the dial 3 of the timepiece provided with this day/night display.

As can be seen, the minutes hand 5 cooperating with the minutes graduation 4 of the timepiece is carried by a minute canon 10 carrying at its other end the minutes wheel 11.

The hours disc 7 is carried by a hours canon 12, pivoted on the minute canon 10, the lower end of which carries the hour wheel 13 of the movement of the time piece provided with the day/night display. A motion work, not shown, connects cinematically the hour wheel 13 to the minute wheel 11.

In the example shown, a second time zone wheel 14 is carried by a canon of second time zone 15 pivoted on the hours canon 12.

The day/night disc 9 is carried by a day/night canon 16, pivoted on the second time zone canon 15, and fast with a day/night wheel 17. The ring of the day/night disc 9 which is visible through the aperture 6 of the dial comprises a first clear zone 9.1 extending on one half of said ring and a second dark zone 9.2 extending on the rest of this ring.

An intermediate mobile 18 comprises a first intermediate wheel 18.1 meshing with the hours wheel 13 and a second intermediate day/night wheel 18.2 meshing with the day/night wheel 17.

The hours wheel 13 is driven by the watch movement of the time piece at the rate of two revolutions in twenty four hours in the anticlockwise direction, but can be driven in the other direction during a time setting. The first intermediate wheel 18.1 of the intermediate mobile 18 has the same number of teeth as the hour wheel 13 with which it meshes and makes therefore also two revolutions in twenty-four hours.

The second intermediate wheel 18.2 comprises a toothed sector 19 extending sensibly over a fourth of its periphery, that is about 70° to 110° separated from a second plain sector 20 extending sensibly over 180°. Two notches 21, 22 separate the toothed sector 19 from the plain sector 20. In this example, the outside radius of the plain sector 20 corresponds approximately to the radius of the foot or the teeth of the toothing of the toothed sector 19, but these radii could be different The second intermediate day/night wheel 18.2 cooperates with the day/night wheel 17 which comprises two toothed sectors 23 intended to mesh with the toothed sector 19 of the second intermediate day/night wheel 18.2, extending each about one forth of the circumference of the day/night wheel 17 and diametrically opposed the one to the other. Between these two toothed sectors 23 of the day/night wheel 17 are disposed two lobes 24 comprising concave terminal faces 25 having the shape of an arc of circle of a diameter corresponding to the diameter of the plain sector 20 of the second intermediate day/night wheel 18.2. These lobes 24 have convex curved sides connecting the lateral ends of the terminal faces 25 to the adjacent toothed sector 23.

The gearing system enables to drive the day/night wheel 17, and thus the day/night disc 9 which it carries from the hour wheel 13 in a continuous way but intermittently (that is a dragging rotation which is periodically hold on or interrupted), at a rate of one revolution in twenty-four hours i.e. two times less than the hours disc 7. When the day/night wheel is driven in rotation it effectuates half a revolution in six hours, as the hours disc.

Figure 6:
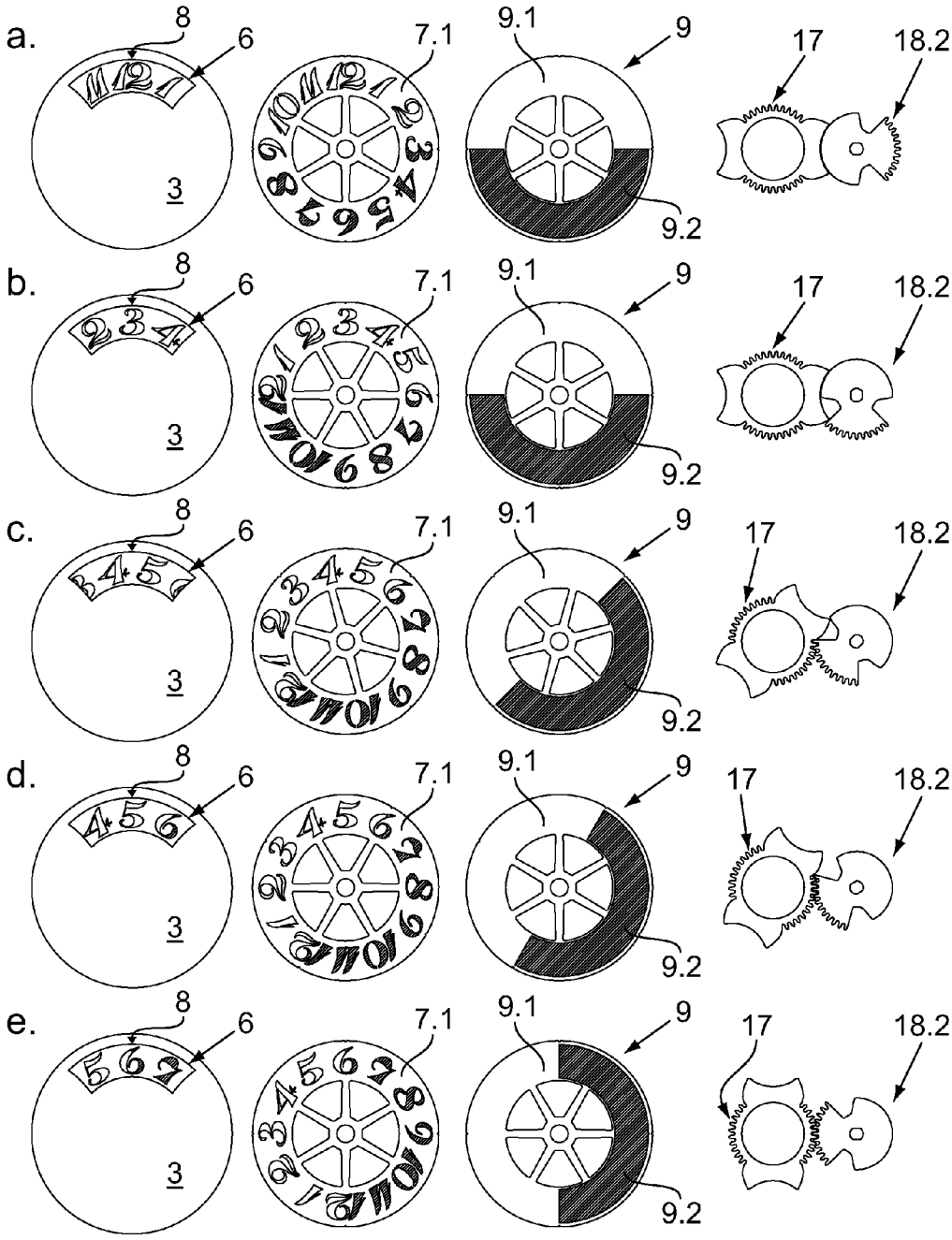
FIG. 6 is a table showing the different positions of the principal elements of the display mechanism for different hours.
Figure 6:
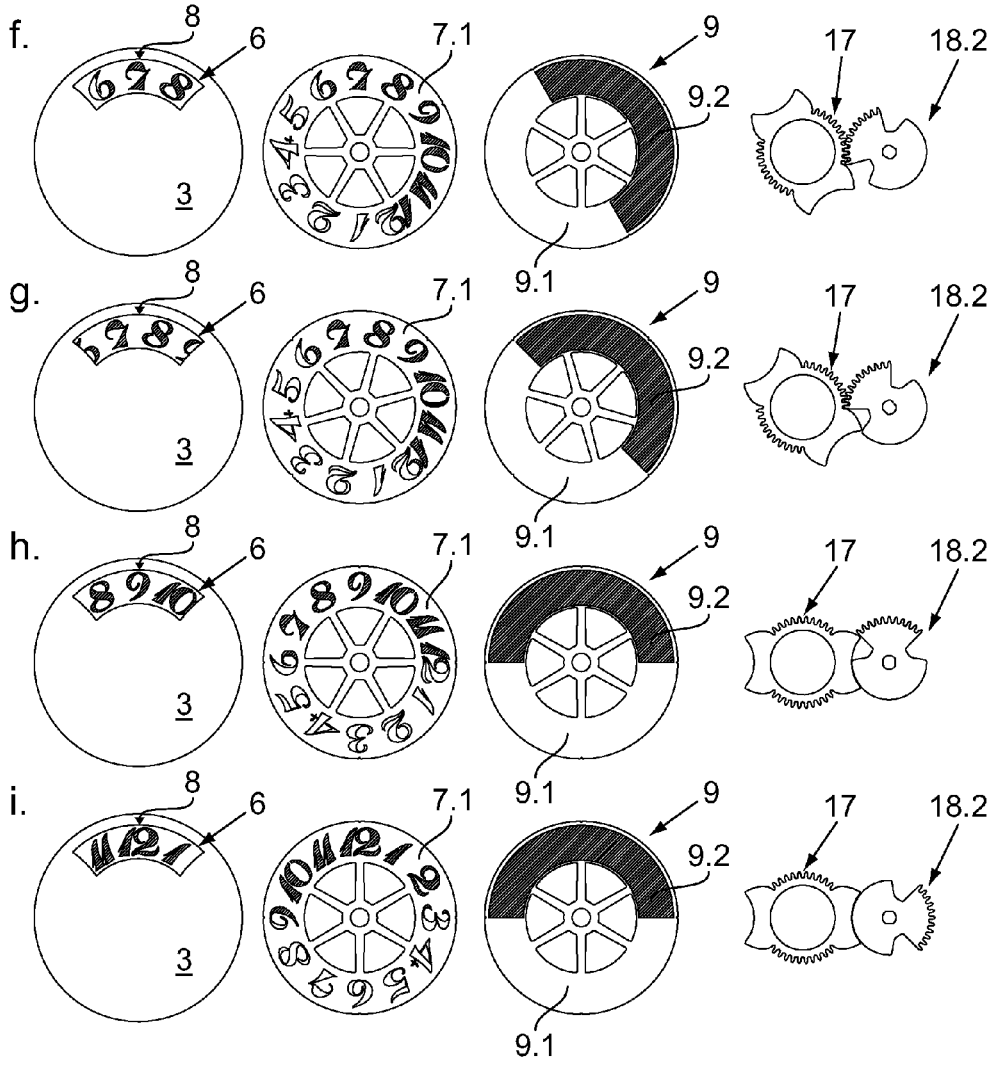

Referring to FIG. 6 representing the cycle of rotation of the hours disc 7 and of the day/night disc 9 (the minutes hand 5 being omitted to simplify the drawing) one sees:

in a, the cipher 12 of the hours disc 7 appears in clear through the aperture 6 of the dial 3 in front of the index 8. The display indicates noon. The day/night disc 9 is oriented in such a way that the clear zone 9.1 forms the upper half of the day/night disc 9. The day/night wheel 17 is oriented in such a way that its lobes 24 are aligned on a line connecting the axis of rotation of the day/night wheel 17 to the axis of rotation of the second intermediate day/night wheel 18.2. The second intermediate day/night wheel 18.2 is positioned in such a way that the central portion of its plain sector 20 is centered on a lateral face 25 of a lobe 24 of the day/night wheel 17, the toothed sector 19 of this second intermediated day/night wheel 18.2 extending to the opposite of the day/night wheel 17, in b, the cipher 3 is displayed in clear in front of the index 8, the display indicates three o'clock and the cipher 2, 3, 4 appear in clear in the opening 6 of the dial. The hours disc 7 has been driven one quarter of a revolution in the anticlockwise direction by the hours wheel 13 in a continuous way and at a constant speed. The second intermediate day/night wheel 18.2 has done one fourth of a revolution in the clockwise direction, its plain sector 20 slides along the terminal surface 25 of the lobe 24 of the day/night wheel and said day/night wheel 17 has rest still as well as the day/night disc 9. One of the sides of the toothed sector 19 begins to cooperate with a side of the lobe 24 so that the second intermediate day/night wheel 18.2 drives the day/night disc 9 in rotation.

in c, the hours disc 7 has continued its rotation and the display indicates half past four in the aperture 6 of the dial 3. The ciphers appear still in clear indicating that it is the day that means sixteen hour and thirty minutes. The day/night disc 9 is now driven in rotation in the clockwise direction by the toothing of the toothed sector 19 of the second intermediate day/night wheel 18.2 cooperating with one of the toothed sectors 23 of the day/night wheel 17, in d, the hours disc 7 has continued its rotation and the cipher five is in front of the index 8. The day/night disc 9 has also continued its rotation the toothed sector 19 of the second intermediate day/night wheel meshing with the toothed sector 23 of the day/night wheel 17. The ciphers 4, 5 and 6 are displayed in the aperture 6 of the dial 3 and one sees that the ciphers six is half clear and half dark due to the relative position of the day/night disc 9 with respect to the hour disc 7. This is the beginning of twilight which is indicated not only by the display of the hour but also by the presence of one cipher partially dark, the six, the other ciphers 4, 5 visible in the aperture 6 being still clear, in e, the hours disc 7 has continued to rotate and the cipher 6, half clear and half dark, is in front of the index 8. The display indicates eighteen hour. The cipher five is clear, the cipher seven is dark so that the dynamic indication of twilight appears. The day/night disc 9 continues to be driven in rotation at the same speed that the hours disc 7 by the hours wheel 13, the intermediated mobile 18 and the day/night wheel 17, in f, the hours disc 7 has continued to be driven and the cipher seven is in front of the index 8. The display indicates thus nineteen hours. The half of the cipher six appears in dark and the cipher seven and eight appear also in dark in the aperture 6. The day/night disc 9 has continued to be driven in rotation synchronously with the hours disc 7 by the intermediate mobile 18 and the night/day wheel 17. Half of the cipher six and the two ciphers seven and eight appear in dark indicating dynamically the progression of twilight in the aperture 6.

in g, the hour disc has continued to rotate and the display indicates nineteen hour and thirty minutes, the index 8 being located between the ciphers seven and eight. All the ciphers or portion of ciphers appearing in the aperture 6 of the dial appear in dark, the day/night disc 9 having also been driven in rotation by the intermediate mobile and the day/night wheel 17. The totality of the ciphers visible in the aperture 6 are dark and this indicates that the display hour is a night hour. In this position the toothed sector 19 of the second intermediate day/night wheel 18.2 is ready to leave the toothed sector 23 of the day/night wheel 17, but one side of the plain sector 20 starts to cooperate with one side of the lobe 24 of the day/night wheel to continue to drive it in rotation as well as the day/night disc 9 simultaneously with the hours disc 7 in h, the hours disc 7 has continued to be driven and the cipher nine is located in front of the index 8. The day/night disc 9 has also continued its rotation driven by the intermediate mobile 18 cooperating with the day/night wheel 17. This day/night disc has now made half a revolution and its dark zone is centered on the aperture 6. The ciphers 8, 9, 10 appear in the aperture 6 and have thus a dark appearance. The display indicates twenty-one hour, the cipher 9 being in front of the index 8 and indicates that it is the night by its color. The day/night wheel 17 is now locked by the cooperation at the periphery of the plain sector 20 of the second intermediate day/night wheel with the lateral face 25 of one lobe 24 of the day/night wheel.

in i, the hours disc has continued its rotation and the cipher 12 is in front of the index 8. The day/night disc 9 stays still during this last rotation of the hours disc 7 the plain sector 20 of the second intermediate day/night wheel 18.2 sliding along the lateral face 25 of the lobe 24 of the day/night wheel 17. The display indicates midnight and the ciphers 11, 12, 1 appearing in the aperture 6 are dark.

During this passage from day to night, from noon to midnight, the hours disc 7 has made one complete revolution but the day/night disc has done only one half revolution in an intermittent way, driven by the second intermediate day/night wheel of one half revolution between fifteen hour and twenty-one hour and staying still from twelve hour to fifteen hour and from twenty-one hour to midnight. During the period between fifteen hour to sixteen hour and thirty minutes the speed of the day/night disc 9 is not constant but changes gradually (but not linearly) in order to reach a speed of one revolution for twelve hours at the end of this period. During the period between sixteen hours and thirty minutes to nineteen hour and thirty minutes the speed of the day/night disc 9 is constant and equal to one revolution in twelve hours. During the period between nineteen hour and thirty minutes to twenty-one hour, the speed of the day/night disc 9 is again not constant and changes gradually (but not linearly) so that this disc stops at the end of this period.

The passage from night to day is made in a similar way going through the steps a to i at the difference that the day/night disc during its half revolution positions progressively the clear zone below the aperture 6 of the dial 3 permitting to make a dynamic representation of daybreak at the beginning of the day between four hour and thirty minutes and seven hour and thirty minutes.

This day/night hour display is particularly interesting in that the hours disc 7 comprises only twelve ciphers 1 to 12 permitting to have a great dimension for these ciphers and thus a good legibility. Furthermore the color of the back of the aperture 6 or of the cipher 1 to 12 indicates not only if it is day or night but give also a dynamic indication of the progression of twilight respectively daybreak.

This result is obtained by the fact that the hours disc 7 carrying the ciphers 1 to 12 make two complete revolutions in twenty-four hours and that the day/night disk make only one complete revolution in twenty-four hours and that its driving during given intervals of time is stopped. Therefore according to the moment of the day the night/day disc 9 can either stand still or be driven with the hours disc 7. This intermittent driving of the day/night disc 9 could in variants of the display be realized differently with other means than the intermediate mobile and the day/night wheel described, for example by means of a mechanism comprising a Maltese cross or an other mechanism.

With the present day/night hour display, the representation of the passage of the day to night is not instantaneous as usually but is made gradually so that during the transition day to night or vice-versa a part of one of the visible ciphers or ciphers be darker than the rest.

In the embodiment described, the day/night disc revolves with the hours disc from 3 h to 9 h and from 15 h to 21 h, the rest of the time it stands still.

In this embodiment, the day/night disc revolves at the same speed as the hours disc during the period sixteen hour thirty minutes to nineteen hour thirty minutes and during the period from four hour thirty minutes to seven hour thirty minutes, that is when a border between the zones 9.1 and 9.2 is visible in the aperture 6. In variants one can modify the speed of rotation of the day/night disc so that it is different from the speed of rotation of the hour disc when the border between the zones 9.1 and 9.2 is visible in the aperture 6. In this way the visual effect of the transformation day/night or vice-versa may be modified, for example in order that the color under the cipher 6 gradually changes from clear to dark or vice-versa during its passage from one side of the aperture to the other.

The ciphers 1-12 can either be cut out in the hours disc as in the embodiments described but they could be formed of a transparent material or translucide materials. In other variants it is the hours disc which may be transparent or translucide and in this case the ciphers do no more appear clear or dark during the transition day/night but it is the background of the aperture 6 which progressively changes its color or shade, the night/day disc being visible between the ciphers 1-12 through the transparent hours disc. In a similar way, the hours disc can have a skeleton shape in order to show cut off portions around the ciphers.

In the example described the day/night disc is driven in rotation when the hours disc displays 3 h to 9 h and 15 h to 21 h. In variants the day/night disc could be driven during two periods of equal or different length, for example from four to eight hours each during twenty four hours. These periods can also be centered respectively on a different time than 6 h or 18 h.

The display of the hours of the present invention could be used for the "home time" with a traditional hours hand for the "local time" or vice-versa.

The hours disc and the day/night disc could also revolve in the clockwise direction in variants. For example, this direction of rotation can be particularly advantageous when the hour display and the fix index 8 are located at the position of 6 h on the dial.

Preferably the clear and dark zones of the day/night disc extend each on half of its periphery, that is 180°.

The invention claimed is:

1. A digital day/night display device for a timepiece, comprising:

an hours disc;

ciphers from 1 to 12 representing hours distributed along a periphery of the hours disc, and realized such that light can pass either through the ciphers or through a portion of the hours disc surrounding the ciphers;

a rotative day/night disc, located under the hours disc comprising a first zone and a second zone of different colors or shades; and a mechanism driving in rotation the hours disc and the day/night disc;

wherein the first zone and the second zone of the day/night disc extend under the ciphers 1-12 of the hours disc, and the mechanism driving in rotation the hours disc and the day/night disc comprises a first means for driving the hours disc in a continuous way and at constant speed at a rate of two revolutions in twenty-four hours and a second means for intermittently driving the day/night disc at a rate of one revolution in twenty-four hours.

2. The display device according to claim 1, wherein the display device further comprises an aperture in a dial through which at least one cipher corresponding to one hour indication can be seen, the hour disc being pivoted under the dial so that during rotation of the hours disc the ciphers which the hours disc carries appear through the aperture.

3. The display device according to claim 2, wherein the aperture has a dimension permitting to see three consecutive ciphers of the hours disc.

4. The display device according to claim 2, wherein the day/night disc is driven in rotation through the second means for driving during two periods of 4 to 8 hours of duration during twenty-four hours and the day/night disc is stand still the rest of the time.

5. The display device according to claim 1, wherein the day/night disc is driven in rotation through the second means for driving during two periods of 4 to 8 hours of duration during twenty-four hours and the day/night disc is stand still the rest of the time.

6. The display device according to claim 5, wherein the day/night disc is driven in rotation during the intervals of time for which the hours disc displays 3 h to 9 h and 15 h to 21 h.

7. The display device according to claim 1, wherein the first and second zones of the day/night disc are each of the same dimension and extend on one angular extension of 180°.

8. The display device according to claim 1, wherein the driving mechanism of the hours disc and of the day/night disc comprises a hours wheel fast with the hours disc, a day/night wheel fast with the day/night disc and an intermediate mobile connecting cinematically the hours wheel to the day/night wheel.

9. The display device according to claim 8, wherein the intermediate mobile comprises a first intermediated wheel meshing with the hours wheel, the toothing of this first intermediate wheel having the same number of teeth as the toothing of the hour wheel.

10. The display device according to claim 9, wherein the day/night wheel comprises two opposed toothed sectors and two opposed lobes comprising each a concave lateral face and two convex sides.

11. The display device according to claim 10, wherein the intermediated mobile comprises a second intermediate day/night wheel comprising a toothed sector and a plain sector cooperating with the day/night wheel.

12. A timepiece comprising a movement; and a digital day/night hour display according to claim 1, the watch movement driving the hours disc of the display in a continuous manner and at a constant speed at the rate of two revolutions in twenty-four hours.

* * * * *